United States Patent [19]

Saunders

[11] 4,117,894

[45] Oct. 3, 1978

[54] DRILL STEEL GUIDE FOR A MINE DRILLING MACHINE

[75] Inventor: Daniel Saunders, Mount Clare, W. Va.

[73] Assignee: Mining Equipment Division, a division of FMC Corporation, Fairmont, W. Va.

[21] Appl. No.: 793,723

[22] Filed: May 4, 1977

[51] Int. Cl.[2] ..... E21C 11/02

[52] U.S. Cl. ..... 173/23; 173/38

[58] Field of Search ..... 173/23, 38, 46, 43; 308/3.9

[56] References Cited

U.S. PATENT DOCUMENTS

| | | | |
|---|---|---|---|
| 2,811,335 | 10/1957 | Fletcher et al. | 173/38 |
| 2,854,217 | 9/1958 | Benjamin | 173/38 |
| 3,218,893 | 11/1965 | Madison et al. | 173/38 |
| 3,375,880 | 4/1968 | Pyles et al. | 173/38 |
| 3,529,680 | 9/1970 | Nardone et al. | 173/38 |
| 3,756,669 | 9/1973 | Bucelluni | 308/3.9 |
| 3,842,610 | 10/1974 | Willis et al. | 173/38 |
| 3,871,707 | 3/1975 | Jamison | 173/46 |

*Primary Examiner*—Robert A. Haffer

*Attorney, Agent, or Firm*—Stanley J. Price, Jr.; John M. Adams

[57] ABSTRACT

A drill pot for rotating a drill steel is supported at the front end portion of a drill boom that extends forwardly from a self-propelled frame. The drill boom raises the drill pot in a straight line to advance the rotating drill steel into the mine roof and drill a bore hole for the installation of a roof bolt. A drill guide carriage is supported at the front end portion of a drill guide boom that also extends forwardly from the machine frame. The drill guide boom is positioned in overlying relation with the drill boom and is raised to move the drill guide carriage in vertical alignment with the drill pot. A pair of drill guide members is pivotally connected to the drill guide carriage for movement into a closed drill guide position surrounding the drill steel. As the drill steel advances into the mine roof, the drill guides members maintain the drill steel axially aligned with the bore hole to prevent rubbing of the drill steel with the sidewall of the bore hole and avoid the necessity for hands-on guiding of the drill steel.

9 Claims, 2 Drawing Figures

DRILL STEEL GUIDE FOR A MINE DRILLING MACHINE

BACKGROUND OF THE INVENTION

1. Field of the Invention

This invention relates to a drill guide assembly for a mine drilling machine and more particularly to a pair of drill guide members of the drill guide assembly that are operable to move into and out of a closed drill guide position surrounding a drill steel to maintain the drill steel axially aligned with the bore hole throughout the drilling operation.

2. Description of the Prior Art

In underground mining, it is the present practice to support the roof of a mine with roof bolts and, in certain instances, with horizontal timbers or metallic tie members secured to the surface of the roof by a plurality of roof bolts that extend through predrilled holes in the timbers or tie members. Also, it is known to substitute the metallic tie members and timbers with a rectangular roof plate that is supported in bearing relation with the roof surface when the roof bolt is fully engaged in the bore hole. A boom supported roof drill as illustrated in U.S. Pat. Nos. 3,319,727 and 3,375,880 includes boom members that support the drill pot for movement of the drill steel in a straight line as it is advanced into the rock strata. The bottom is positioned on a self-propelled vehicle that is movable to preselected locations in the mine entry for installing roof bolts in accordance with a preselected pattern that provides the optimum support of the overhead roof.

The mobile boom-type drilling machines include a linkage mechanism for moving the drill pot mounted on the front end portion of the drill boom in a vertical linear path. Means is also provided for mechanically varying the linkage to permit the drill to move in a path at an angle and in a vertical plane. In this manner, fore and aft angular adjustment for the drill steel is made and it is possible to change the angular path of the drill from a straight line vertical path to a vertical fore or aft angular path relative to the mining machine.

When the bolt holes are being drilled in relatively hard materials substantial problems are encountered in aligning the drill steel with the axis of the bore hole during the drilling operation, especially where the bolt holes are a substantial depth. It has been found extremely difficult to maintain the drill steel aligned with the bore hole throughout the entire drilling operation. When one drills in hard material, frequently the drill steel will penetrate the hard material and be deflected slightly or tilt relative to the vertical axis. Continued vertical drilling when the drill steel is tilted or deflected and not aligned with the bore hole causes the drill steel to rub against the sidewall of the bore hole, especially at a location adjacent the roof surface. Under certain circumstances, the rubbing of the drill steel on the collar of the hole causes the drill steel through friction to overheat and break. As is well known, this frictional rubbing can also cause a fire hazard at the mine face in gaseous mines. The rubbing of the drill steel against the sides of the bore hole also absorbs a substantial amount of the thrust energy imparted to the drill and reduces the drilling efficiency.

To maintain axial alignment of the drill steel with the bore hole it is the conventional practice for the operator, particularly in "spotting" the drill head to start the bore hole, to steady the drill steel with his hand. The operator continues to hold the drill steel as it advances into the mine roof to maintain the drill steel in a vertical axis for drilling a bore hole in a straight line. Thus the operator uses his hand to align the drill steel with the axis of the bore hole when the drill steel deflects and rubs against the sidewall of the bore hole. Such a practice subjects the drill operator to substantial risk of injury and should be avoided.

The following United States patents disclose a drill steel guide for centering the drill steel during starting of the bore hole: U.S. Pat. Nos. 2,350,658 2,350,659 2,350,660 2,350,661 2,365,680 2,365,681 2,365,682 2,365,683 2,365,684 2,365,685 2,365,686 2,365,687 2,394,806

These references relate generally to drill steel centralizers for a hammer type face drilling machine where the drill tool is fed along guideways of a guide toward and from the work by a feed screw. A pair of cooperating centralizer arms are mounted on the guide and include guide portions for engaging the body of the drill steel to center the drill steel during starting of the drill hole. Once the drill hole is started the guide portions are released from engagement with the drill steel.

There is need for a drill steel guide for boom type mine drilling machines to maintain the drill steel axially aligned with the bore hole and eliminate rubbing of the drill steel with the sidewall of the bore hole and thus avoid the necessity for hands-on application of the drill steel by the operator to prevent misalignment.

SUMMARY OF THE INVENTION

In accordance with the present invention there is provided for a mine drilling machine, a drill steel guide that includes a support frame. A drill guide boom assembly having a front end portion and a rear end portion is positioned on the support frame. A pivot mechanism connects the drill guide boom assembly to the support frame and is operable to move the drill guide boom assembly front end portion in a vertical linear path. A drill guide carriage is mounted on the boom assembly front end portion. A pair of drill guide members is pivotally connected to the drill guide carriage for movement toward and away from each other. Each of the drill guide members has a guide portion adapted to surround a drill steel. An actuator mechanism is linked to the drill guide members and is operable to pivot the drill guide members to move the guide portions thereof to a closed drill guide position surrounding the drill steel and an open position.

A drill boom member is supported on the support frame in underlying relation with the drill guide boom. The rear end portion of the drill boom is supported for rectilinear movement on a slide block that supports the rear end portion of the drill boom. In a similar arrangement the rear end portion of the drill guide boom is supported for rectilinear movement on the slide block with the rear end portion of the drill guide boom positioned between and in overlying parallel relation with the rear end portion of the drill boom.

The drill guide boom and the drill boom extend forwardly from the support frame, and the drill boom supports a drill pot at the front end portion thereof. The drill pot rotatably supports the drill steel of a drill rod that extends vertically upwardly through the drill guide carriage between the drill guide members. A suitable motor, such as a hydraulic motor, is operable to impart rotary motion through the drill pot to the drill steel for rotating the drill rod. The drill rod has a drill head at the upper end portion which is advanced into the mine roof.

The drill pot is raised vertically in a straight line upon the actuation of a hydraulically operated lift jack that is supported at one end to a stabilizing portion positioned on the mine floor. The hydraulic lift jack is pivotally connected to the drill boom by an elevating link which is pivotally connected to the stabilizing portion. Actuation of the lift jack to raise the drill boom pivots the elevating link to raise the front end portion of the drill boom vertically in a linear path. A second lift jack supported by the stabilizing portion is connected to the drill guide boom and is operable to raise the front end portion of the drill guide boom vertically in a linear path which is aligned with the linear path of the drill boom so that the drill guide assembly rises on a vertical axis aligned with the vertical axis of movement of the drill pot.

In the closed drill guide position the guide portions of the drill guide members surround the drill steel to maintain upward movement of the drill steel along a vertical axis. In this manner the drill steel is maintained coaxially alinged in the bore hole to prevent the rubbing of the drill steel against the sidewall of the bore hole. As the drill pot is vertically raised to advance the rotating drill steel into the bore hole the drill guide assembly also advances vertically to maintain the drill aligned with the bore hole.

A roof support is pivotally supported on the front end portion of the drill guide boom for engaging the mine roof to stabilize the drill guide carriage adjacent the mine roof. The roof support includes a generally rectangular frame member positioned above and in surrounding relation with the drill guide carriage. The frame member is pivotally connected to the front end portion of the drill guide boom. The frame member has an upper horizontal surface arranged to abut the mine roof when the drill guide boom raises the drill guide carriage to an uppermost position adjacent the mine roof.

Further in accordance with the present invention, in order to support the mine roof above the drill pot during the drilling operation, the drill guide boom is raised to position the roof support abutting the roof surface. With the drill steel extending through the drill guide carriage and the drill head spotted against the roof, the drill guide members are moved to the closed drill guide position. The drill guide members maintain the drill steel in a vertical position as the drill steel advances into the rock strata. As the drill pot rises, the drill steel advances axially through the drill bore and the roof support stabilizes the mine roof around the bore hole. In this manner the drill guide assembly functions to support the mine roof during the drilling operation.

The drill steel guide is also operable to maintain vertical alignment of a roof bolt in the bore hole as the roof bolt is installed in the mine roof. The roof bolt replaces the drill rod in the drill pot which is adapted for roof bolting operations. It is the conventional practice to position a bearing or roof plate on the roof bolt and advance the bearing plate with the roof bolt into contact with the roof surface. To accommodate positioning of the bearing plate on the roof surface, the drill guide members are pivoted on the drill guide carriage to the open position to permit the bearing plate to pass through the drill guide carriage into contact with the roof surface.

The drill guide members include a first lever arm and a second lever arm with each lever arm including the guide portions at one end portion with the opposite end portion of the lever arms pivotally connected to the drill guide carriage. The first lever arm is connected to the actuator mechanism and is connected to the second lever arm by a link member. The actuator mechanism is operable to pivot the first lever arm and thereby pivot the second lever arm through the link member to move the guide portions into and out of the closed drill guide position surrounding the drill steel. This arrangement ensures upon each cycle of operation of the actuator mechanism that the guide portions are moved into position surrounding the drill steel so that the drill steel is aligned with the axis of the bore hole during the drilling operation.

Accordingly, the principal object of the present invention is to provide for a mine drilling machine, a drill guide assembly that is operable to maintain alignment of a drill steel with the axis of a bore hole during roof drilling operations.

Another object of the present invention is to provide a drill guide assembly for a mine drilling machine having a boom supported drill pot that is operable to advance a drill rod along a vertical linear path into the mine roof for drilling a bolt hole where the drill guide assembly is movable along the vertical axis of movement of the drill pot to maintain the drill steel aligned with the bore hole throughout the entire drilling operation.

A further object of the present invention is to provide a drill guide assembly for a mine roof drilling machine having a drill pot supported by a drill boom for advancing a drill steel in a vertical linear path into a bore hole of the mine roof with the drill guide assembly arranged to maintain the drill steel aligned with the bore hole to prevent the rubbing of the drill steel with the sidewall of the bore hole.

These and other objects of the present invention will be more completely disclosed and described in the following specification, the accompanying drawings and the appended claims.

DESCRIPTION OF THE PREFERRED EMBODIMENT

Figure 1:
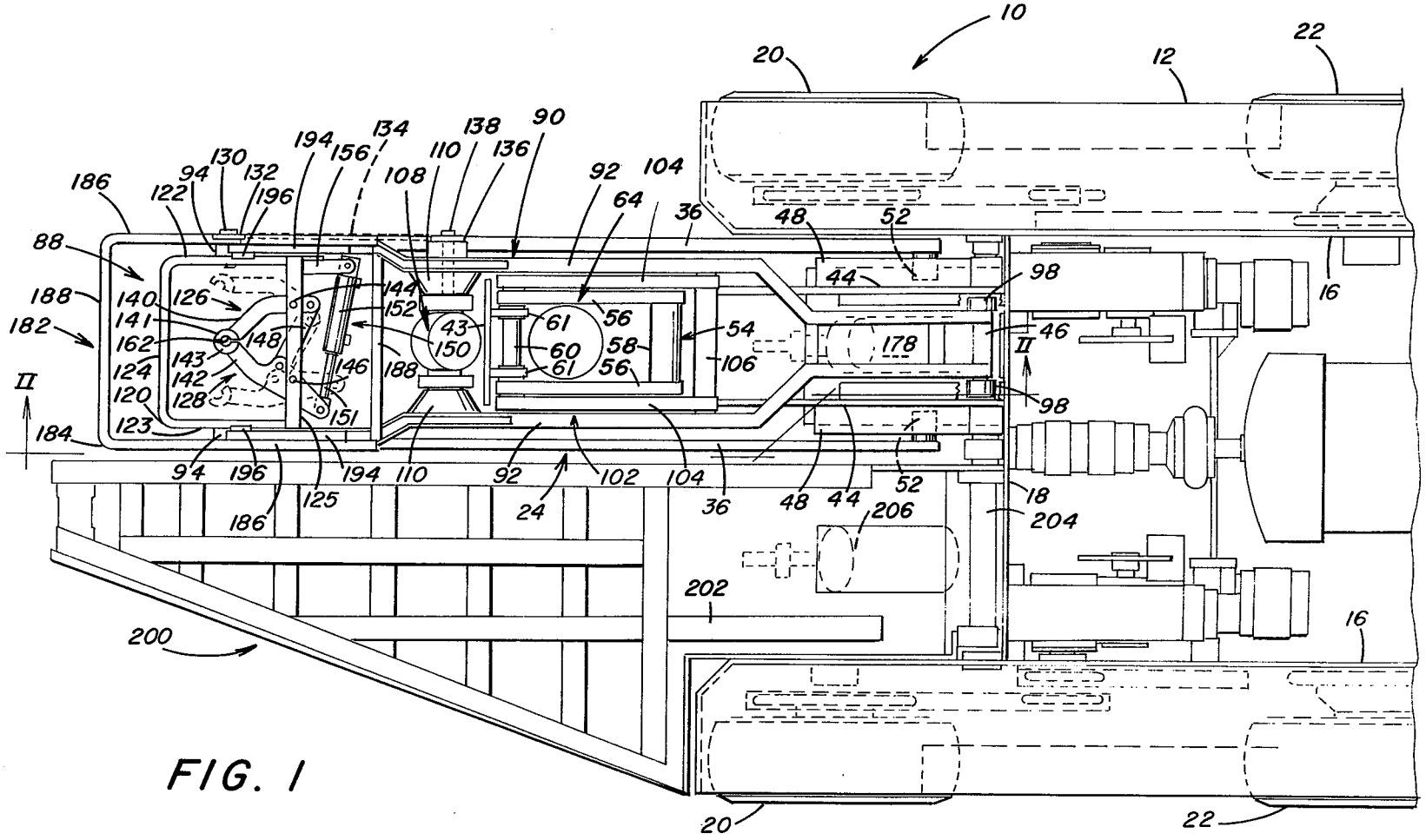
FIG. 1 is a fragmentary top plan view of a mine drilling machine, illustrating a drill guide assembly for guiding a drill steel as the drill is advanced in a straight line into the mine roof.

Referring to the drawings, there is illustrated a mine drilling machine generally designed by the numeral 10 that generally takes the form of a low, self-propelled car that includes a frame 12 mounted upon a wheeled suspension generally designated by the numeral 14. The frame may take a conventional form such as spaced, parallel side plates 16 that are connected by a front sill 18 and a plurality of transverse bridge members (not shown). The suspension 14 includes a pair of front wheels 20 and a pair of rear wheels 22 that are connected to the frame 12 for steering of the frame 12; while, the front wheels 20 are driven in a conventionally known manner. With this arrangement, the mine drilling machine 10 is suspended in such a fashion that the wheels follow the mine floor contour while the frame 12 remains horizontal. Further details of the wheeled suspension 14 are illustrated and described in U.S. Pat. No. 3,252,525 which is incorporated herein by reference.

A drill boom generally designated by the numeral 24 lies longitudinally over the front part of the frame 12 and projects outwardly therefrom to carry a drill pot 26. The drill boom 24 is mounted so that it raises the drill pot in a linear vertical path, i.e., the drill pot 26 moves vertically in a straight line. The drill pot 26 includes a rotatable chuck that is driven by a suitable motor 28 for rotating a drill rod generally designated by the numeral 30. The drill rod 30 includes a drill steel 32 extending up from the drill pot 26 with a drill head 34 secured to the upper end of the drill steel.

The drill boom 24 includes a pair of boom arms 36 held in spaced, parallel relation by an interconnecting web (not shown). The frame 12 includes a stabilizing portion 40 that is connected to the front end of the frame 12 by a horizontal pivot pin 42 for pivotal movement of the stabilizing portion 40 about a horizontal axis. The stabilizing portion 40 includes a front wall 43 and vertical sidewalls 44 held in spaced parallel relation by a transverse bridge member 46. A slide block 48 is secured to each of the sidewalls 44 adjacent the pivot pin 42 and includes inclned spaced, paralled slide surfaces 50 (only one of which is illustrated in phantom in FIG. 2). Rollers 52 are rotatably connected to the end portion of each of the boom arms 36 and are mounted rotatably supported by the slide block surfaces 50. With this arrangement for the rear end of the drill boom 24 is mounted for rectilinear movement on the frame 12.

The boom arms 36 are connected to an elevating link generally designated by the numeral 54 that includes a pair of link arms 56 held in spaced relation by a bridging web 58. The link arms 56 are pivotally connected at one end portion by a pivot pin 60 that extends through flanges 61 that project rearwardly from front wall 43 of the stabilizing portion 40. The opposite end portions of the link arms 56 are pivotally connected to the boom arms 36 by a pivot pin 62 that extends through the bridging web 58 and is rotatably journaled at its opposite end portions to the boom arms 36. With this arrangement, the elevating link 54 is operable for vertical swinging movement to raise and lower the drill boom 24. As the elevating link 54 moves vertically, the boom arm rollers 52 move forwardly on the slide block surfaces 50. Thus the normal arcuate movement of the boom around a fixed horizontal pivot is compensated by the above arrangement so that the drill pot 26 moves along a straight vertical path.

In order to raise and lower the drill boom 24, an elevating device, generally designated by the numeral 64, is utilized and includes a hydraulically actuated lift jack 66 having a piston rod 68 pivotally connected by pivot pin 70 to the stabilizing portion 40. The jack 66 is pivotally connected to the link arms 56 by trunnions 69 on opposite sides of the jack cylinder 71. The jack 66 is connected by suitable means to a hydraulic motor which upon actuation is operable to extend or retract the piston rod 68 and raise or lower the link arms 56 about its pivotal connection to the stabilizing portion 40. In this manner the drill boom 24 and the drill pot 26 are raised and lowered.

Figure 2:
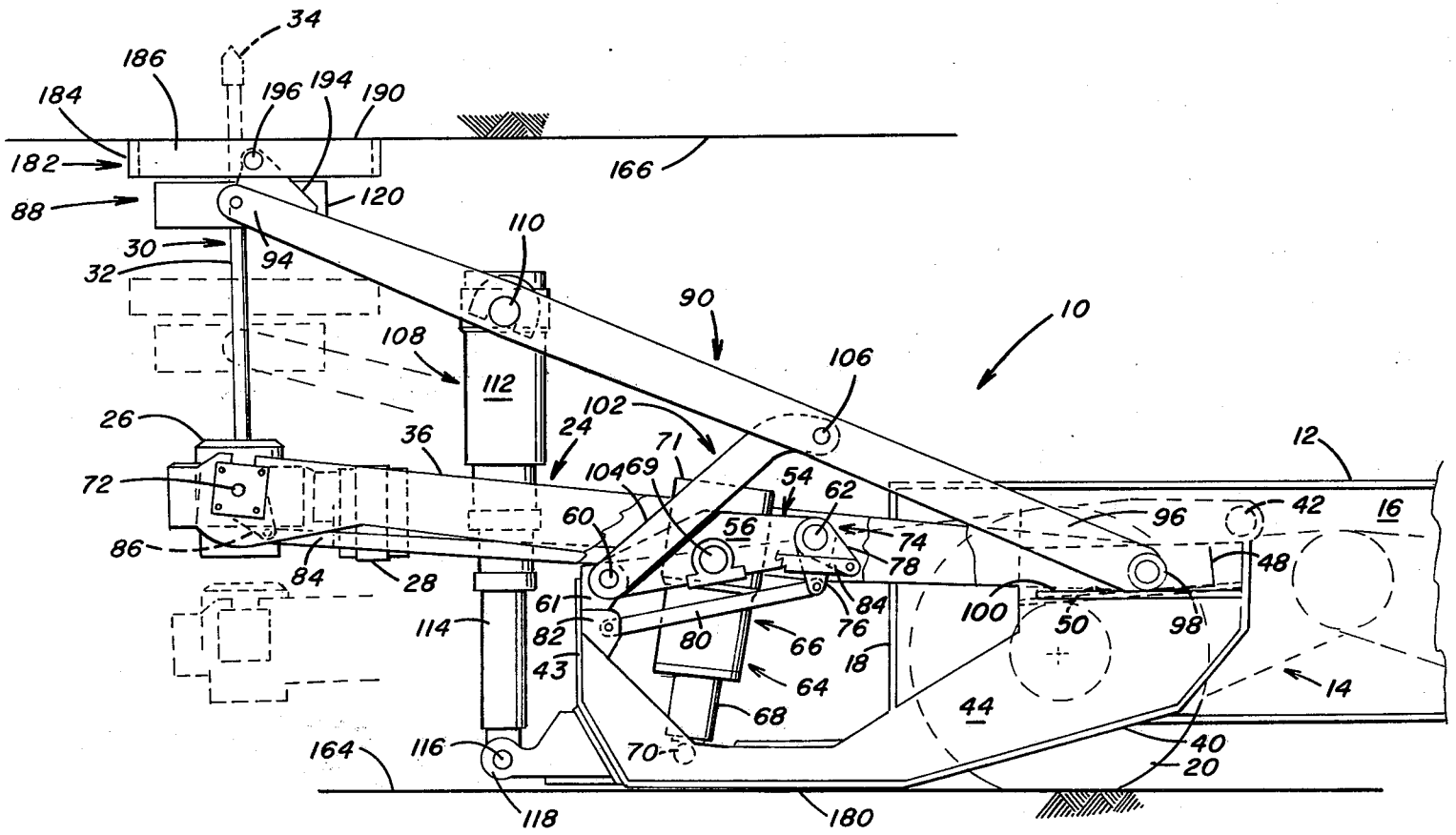
FIG. 2 is a fragmentary view in side elevation taken along line II—II of FIG. 1, illustrating the pivotal movement of a drill guide boom that supports the drill guide assembly in overlying relation with a drill pot carried on the end of a drill boom.

The drill pot 26 is pivotally connected to the boom arms 36 by trunnions 72 which project outwardly from the drill pot 26. During upward movement, the drill boom 24 constantly changes its angular position, and it is therefore necessary to provide means to maintain the drill pot level with the drill rod shaft axis vertical. This is accomplished by a pivot link generally designated by the numeral 74 that is pivotally mounted on the pivot pin 62 outboard of the link arms 56. The link 74 includes a pair of arms 76 and 78 as illustrated in FIG. 2. Arm 76 is connected by a pair of rods 80 to a bracket 82 on the stabilizing portion 40. The arm 78 is connected by a rod 84 to a lever arm 86 fixed to each of the trunnions 72 on the drill pot 26. With this arrangement pivot 62, the pivotal connection between arm 78 amd rod 84 and lever arm 86 and trunnions 72 form the pivots of a parallelogram so that the drill pot 26 moves upward in a straight line with the front end of the drill boom 24.

The upward advancement of the drill steel 32 is maintained in a vertical line by a centralizer or drill guide assembly generally designated by the numeral 88. The drill guide assembly 88 is positioned in overlying relationship with the drill pot 26 by a drill guide boom generally designated by the numeral 90. The drill guide boom 90 is positioned longitudinally over the front part of the frame 12 and projects outwardly therefrom in overlying relation with the drill boom 24. The drill guide boom 90 is mounted on the frame 12 in a manner similar to the drill boom 24 to permit movement of the drill guide assembly 88 along a linear vertical path.

The drill guide boom 90 includes a pair of spaced, parallel boom arms 92 having a front end portion 94 that supports the drill guide assembly 88 and a rear end portion 96 having rollers 98. The rollers 98 are rotatably connected to the rear end portion 96 of each of the boom arms 92, and the rollers 98 are rotatably supported by spaced, parallel horizontal slide surfaces 100 of each of the slide blocks 48. Only one slide surface 100 is illustrated in FIG. 2. With this arrangement the rear end portion 96 of each of the boom arms 92 is mounted for rectilinear movement on the frame 12.

The drill guide boom 90 is connected by an elevating link generally designated by the numeral 102 to the stabilizing portion 40. The elevating link 102 includes a pair of arm members 104 that are pivotally connected at their front end portions to the pivot pin 60 on the stabilizing portion 40. The rear end portions of the arm members 104 are connected by a transverse bridge member 106 which is rotatably journaled at its end portions to the boom arms 92. The drill guide boom 90 is raised and lowered by an elevating device such as a drill guide boom lift jack 108 which is preferably hydraulically operated and includes trunnions 110 on opposite sides of a cylinder portion 112. The trunnions 110 are rotatably journaled at their end portions to the boom arms 92.

The hydraulic jack 108 is positioned between the boom arms 92 forward of the lift jack 66 for the drill boom 24. The hydraulic jack 108 includes a piston end portion 114 that is pivotally connected by a pivot pin 116 to ears 118 extending forwardly of the stabilizing portion 40. The hydraulic jack 108 is connected by suitable means to a hydraulic motor which upon actuation is operable to extend or retract the piston rod 114 and raise or lower the boom arms 92 relative to the boom arms 36.

In operation, extension of the piston rod 114 vertically lifts the front end portion 94 of each of the boom arms 92 as the rear end portion 96 of each of the boom arms 92 advances rectilinearly by forward movement of the rollers 98 on the slide surfaces 100 of the slide blocks 48. As the boom rear end portions 96 advance forwardly the elevating link arm members 104 pivot upwardly about the pivot pin 60 on the stabilizing portion 40. The upward movement of the boom arms 92 combined with the advancement of the rollers 98 on the slide surfaces 100 maintains the drill guide assembly 88 in a vertical plane so that the drill guide assembly 88 moves vertically in a straight line. With the drill guide assembly 88 supported on the front end portions 94 of the boom arms 92, the drill guide assembly 88 follows a vertical axis which is aligned with the vertical axis the drill 30 of the drill pot 26 follows.

The drill guide assembly 88 includes a drill guide carriage 120 that is constructed as a rectangular frame having spaced longitudinal members 122 and 123 connected by transverse members 124 and 125. A pair of drill guide members 126 and 128 are pivotally connected to the transverse member 125 for movement toward and away from each other into and out of a closed drill guide position surrounding the drill steel 32 of the rod 30 in a manner to be explained further in greater detail. The longitudinal members 122 and 123 of the drill guide carriage 120 are pivotally connected to the forward end portion 94 of each of the boom arms 92 by pins 130. Each of the pins 130 is nonrotatably secured to the longitudinal members 122 and 123 at one end portion and is rotatably connected to the boom arm end portions 94 at the opposite end portion.

A selected one of the pins 130 extends outwardly from the respective boom arm end portion 94. A sprocket 132 is nonrotatably secured to the selected pin 130 and is drivingly connected by an endless chain 134 to a sprocket 136. The sprocket 136 is nonrotatably connected to the end portion of a shaft 138 that is rotatably supported by the adjacent boom arm 92 and connected to the trunnion 110 on one side of lift jack 108. With this arrangement, as the lift jack 108 is actuated to extend the piston rod 114 from the cylinder 112, the lift jack 108 pivots forwardly to a position substantially vertical with the ground. Consequently, the shaft 138 pivots with the associated trunnion 110 to rotate the sprocket 136 through an angle corresponding to the pivotal angle of the jack 108. Rotation of the sprocket 136 is transmitted by the chain 134 to the sprocket 132. Rotation of the sprocket 132 rotates the pin 130 through the angle of rotation of shaft 138. Rotation of the shaft 138 pivots the carriage 120 forwardly on the boom front end portions 94 through an angle corresponding to the forward pivotal movement of the lift jack 108. Thus, as the boom arms 92 rise vertically and the front end portions 94 follow a straight line path, the drill guide carriage 120 is maintained parallel to the ground.

The drill guide members 126 and 128 include lever arms 140 and 142 having guide portions 141 and 143 respectively at their end portions. The arms 140 and 142 are intermediately connected to the transverse member 125 by pivot pins 144 and 146. The opposite end portion of lever arm 140 is connected by a link member 148 to the lever arm 142. The opposite end portion of the lever arm 142 is, in turn, connected to an actuator mechanism generally designated by the numeral 150 that includes a piston rod 151 that extends and retracts from a cylinder portion 152. The cylinder portion 152 is pivotally connected to a bracket 156 that extends rearwardly from transverse member 125.

In operation, actuation of the cylinder 152 extends the piston rod 151 from the cylinder 152 to pivot the lever arm 142 on the transverse member 125 from the position illustrated in dotted lines to the position illustrated in solid lines in FIG. 1. Pivoting the lever arm 142 in this direction moves the link member 148 to pivot the lever arm 140 from the position illustrated in dotted lines to the position illustrated in solid lines. In this manner the lever arms 140 and 142 move toward each other until the guide portions 141 and 143 abut. The guide portions 141 and 143 have a semicircular configuration, and when positioned in abutting relation the guide portions form a bore 162.

Accordingly, retraction of piston rod 151 into the cylinder 152 pivots the lever arm 142 on the transverse member 124 to the dotted line position. This pivotal movement is transmitted by link member 148 to the lever arm 140 so that the lever arm 140 is pivoted to the dotted line position. Movement of the lever arms 140 and 142 to this position moves the guide portions 141 and 143 out of abutting relation. The link member 148 connecting the lever arm 140 to the lever arm 142 ensures that each time the piston rod 151 is extended the lever arms are pivoted to position the guide portions 141 and 143 in abutting relation.

In operation, the mine drilling machine 10 is maneuvered through the mine on the mine floor 164 to a position where the drill pot 26 underlies the location on the mine roof where a bore hole is to be drilled for the installation of a roof bolt to support that location of the mine roof. During tramming of the mining machine 10 the stabilizing portion 40 is pivoted upwardly on the frame 12 by a piston cylinder assembly 178 that is mounted at its cylinder portion to the frame 12 and is connected at its piston rod portion to the stabilizing portion 40. Actuation of the piston cylinder assembly 178 to retract the piston rod pivots the stabilizing portion 40 about pivot pin 42 to lower surface 180 of portion 40 into contact with the mine floor 164. With the stabilizing portion 40 positioned on the mine floor the respective boom assemblies 24 and 90 are positioned to raise the drill pot 26 and the drill guide assembly 88 vertically on a common vertical axis.

With a drill rod 30 positioned in the drill pot 26, the lift jack 108 is actuated to raise the drill guide boom arms 92 to a preselected height overlying the drill pot 26 so that the drill guide carriage 120 is positioned above the drill pot 26. Initially, the lever arms 140 and 142 are pivoted to the open position, as illustrated by the dotted lines in FIG. 1. With the drill head 34 of the drill rod 30 contacting the mine roof 166 at the location for drilling a bore hole, the actuator 150 is actuated to extend the piston rod 151 to move the lever arms 140 and 142 to a closed drill guide position surrounding the drill steel 32 but removed from contact with the drill steel 32. With this arrangement, the bore 162 formed by the abutting relation of the semicircular portions of the guide portions 141 and 143 has a diameter greater than the diameter of the drill steel 32.

The drill motor 28 is actuated to rotate the drill rod 30 and simultaneously the lift jacks 66 and 108 are actuated to raise the drill pot 26 and the drill guide carriage 120 in a linear vertical path along the same vertical axis. This is accomplished as described above by the rectilinear movement of the rear end portions of the booms 24 and 90 on the slide blocks 48. As the drill pot 26 advances the drill steel upwardly into the mine roof, the abutting guide portions 141 and 143 maintain the movement of the drill steel 32 along a preselected vertical axis. In this manner the drill steel 32 is not deflected from the vertical axis and is maintained in alignment with the bore hole. This eliminates the rubbing of the drill steel against the sidewall of the bore hole. Thus, with the present invention, the operator is not required to manually guide the drill steel into the bore hole and the hazards to personal injury which occur as a consequence of such practice is avoided.

The drill guide assembly 88 may also include a roof support generally designated by the numeral 182 which is positioned on the front end portion of the drill guide boom 90. The roof support 182 includes a generally rectangular frame 184 having longitudinal members 186 connected to transverse members 188. The members 186 and 188 form an upper horizontal surface 190 arranged to abut against the mine roof. The longitudinal members 186 are supported by a pair of brackets 194 that extend upwardly from the front end portions 94 of each of the boom arms 92. The brackets 194 are pivotally connected by pins 196 to the longitudinal members 186. With this arrangement, when the upper horizontal surface 190 is moved into abutting relation with the mine roof 166, the frame 184 will pivot about the pins 196 to allow substantially the entire surface area of the surface 190 to abut the mine roof 166 as determined by the irregular contour of the mine roof 166.

Once the roof support 182 is positioned in abutting relation with the mine roof 166, the lift jack 108 maintains this position. As the drill boom 24 continues to raise the drill pot 26 and the drill steel 32 advances into the bore hole, the roof support 182 supports the immediate area of the mine roof around the bore hole being drilled and further stabilizes the drill guide assembly 88.

When drilling of the bore hole has been completed the drill pot 26 is lowered along the same vertical axis as it was raised by downward movement of the drill boom 24 by retraction of the piston of the lift jack 66. As the drill steel 32 is withdrawn from the bore hole in the mine roof, the roof support 182 remains abutting the roof surface to support the roof. The drill guide members 126 and 128 remain in the closed drill guide position so that the drill steel moves vertically downwardly. When the drill pot 26 has been lowered, for example, to the position illustrated in phantom in FIG. 2, the drill head 34 is fully withdrawn. The drill guide members 126 and 128 are moved to the open position to permit the drill head 34 to pass in an unobstructed manner through the drill guide carriage 120.

It is the conventional practice in mine roof support operations to adapt the drill pot for inserting a roof bolt in the bore hole. Once the drill pot is adapted for bolting operations, the roof bolt is inserted in the bore hole in much the same manner the drill rod is advanced into the mine roof. To this end the drill guide assembly 88 of the present invention is utilized to maintain movement of the roof bolt along a vertical axis which prevents the shank of the roof bolt from rubbing the sidewalls of the bore hole. In addition it is the practice to position a bearing plate on the roof bolt for positioning the bearing plate abutting the roof surface surrounding the opening to the bore hole.

In operation, the drill boom 24 advances the drill pot 26 and the roof bolt upwardly into the bore hole. The drill guide boom 90 is in position to maintain the frame 184 in roof support position so that the mine roof is supported as the bolt advances, and the guide portions 141 and 143 maintain the roof bolt in axial alignment with the bore hole. To accommodate passage of the bearing plate through the drill guide carriage 120, the lever arms 140 and 142 are moved to an open position where the guide portions 141 and 143 are sufficiently spaced apart to permit the bearing plate to pass through the drill guide carriage 120 and roof support frame 184 into position abutting the mine roof. Thus, both the roof drilling and roof bolting operations are performed without the necessity for the drill pot operator to come in contact with either the drill rod or roof bolt. This eliminates substantial hazards to which the drill operator heretobefore has been exposed when attempting to manually adjust the vertical alignment of the drill rod or roof bolt.

Also, the hazards of drilling and bolting operations are reduced by the installation of a protective canopy, generally designated by the numeral 200 in FIG. 1, associated with the drill boom 24 and the drill pot 26. The protective canopy 200, of the type illustrated and described in U.S. Pat. No. 3,865,197, is supported adjacent the drill boom 24 by boom arms 202 that are pivotally connected to the sill 18 of the frame 12 by a bridging web 204. A piston cylinder assembly 206 mounted on the frame 12 and connected at its piston end portion to the canopy boom 202 is operable upon actuation to raise and lower the canopy 200 into and out of abutting relation with the mine roof 166. With this arrangement, during the drilling and bolting operations the canopy boom 202 is raised to position the canopy 200 against the mine roof to support the mine roof so that the drill pot operator standing beneath the canopy is protected from dislodged material falling from the mine roof.

This feature, together with the provision of the drill guide assembly 88 and the roof support 182 associated therewith, substantially reduces the hazards to which the drill pot operator is exposed. Further in accordance with the present invention, while reference has been made to maintaining advancement of the drill steel along a vertical axis, it will also be apparent from the present invention that the drill guide assembly 88 is also operable to maintain travel of the drill steel along an axis at an angle to the vertical in a straight line.

According to the provisions of the patent statutes, I have explained the principle, preferred construction and mode of operation of my invention and have illustrated and described what I now consider to represent its best embodiments. However, it should be understood that, within the scope of the appended claims, the invention may be practiced otherwise than as specifically illustrated and described.

I claim:

1. In a mine drilling machine, a drill steel guide comprising, a support frame, a drill boom assembly having a front end portion and a rear end portion, said drill boom assembly rear end portion pivotally connected to said support frame for vertical pivotal movement of said drill boom assembly front end portion relative to said support frame, means for pivoting said drill boom assembly adjacent said rear end portion thereof relative to said support frame so that said front end portion moves in a vertical linear path, a drill pot pivotally connected to said front end portion of said drill boom assembly and operable to carry an upwardly extending drill steel therefrom, a separate drill guide boom assembly extending in parallel overlying relation with said drill boom assembly and having a front end portion and a rear end portion, pivot means for connecting said drill guide boom assembly to said support frame for moving said drill guide boom assembly front end portion in a vertical linear path, a drill guide carriage mounted on said drill guide boom assembly front end portion, a pair of drill guide members pivotally secured to said drill guide carriage for movement toward and away from each other, said drill guide members each having a guide portion, actuator means linked to said drill guide members for pivoting said drill guide members to move said guide portions to a closed drill guide position surrounding the drill steel and an open position, and said drill guide carriage being supported by said drill guide boom assembly front end portion above said drill pot, said drill guide boom being movable upwardly to a location adjacent the mine roof to position said drill guide carriage adjacent said mine roof so that said drill guide members remain in a closed drill guide position surrounding the drill steel as said front end portion of said drill boom assembly with said drill pot mounted thereon moves upwardly from a location adjacent the mine floor in a vertical linear path.

2. In a mine drilling machine, a drill steel guide as set forth in claim 1 which includes, elevating means independently connecting said drill guide boom assembly and said drill boom assembly to said support frame, a pair of elevating links connecting said drill guide boom assembly and said drill boom assembly to said support frame respectively, said elevating links being operable upon actuation of said elevating means to independently raise said drill guide carriage and said drill pot in a straight line through a preselected linear path, and said guide members being operable to maintain the closed drill guide position with the drill steel as said drill boom assembly raises said drill pot to maintain the drill steel aligned with the preselected linear path.

3. In a mine drilling machine, a drill steel guide as set forth in claim 1 which includes, elevating means connected to said drill guide boom assembly for raising said front end portion of said drill guide boom assembly, ground engaging means connected to said support frame for stabilizing said elevating means, said pivot means including an elevating link pivotally connected to said ground engaging means and said drill guide boom assembly, roller means for supporting said rear end portion of said drill guide boom assembly for rectilinear movement on said support frame, and said elevating means being operable upon actuation to raise said drill guide carriage in a straight line as said drill guide boom assembly rear end portion advances forwardly on said support frame.

4. In a mine drilling machine, a drill steel guide as set forth in claim 1 which includes, elevating means pivotally connected to said drill guide boom assembly for raising said front end portion of said drill guide boom assembly, means associated with said support frame for stabilizing said elevating means, leveling means associated with said elevating means and connected to said drill guide carriage for maintaining said drill guide carriage parallel to the ground as said elevating means raises said drill guide boom assembly.

5. In a mine drilling machine, a drill steel guide as set forth in claim 4 in which said leveling means includes, first pivot means for pivotally connecting said elevating means to said drill guide boom assembly, said first pivot means being operable to rotate as said elevating means raises said drill guide boom assembly, second pivot means for pivotally connecting said drill guide carriage to said drill guide boom assembly front end portion to maintain said drill guide carriage parallel to the ground, means for connecting said first pivot means to said second pivot means so that as said drill guide boom assembly rises pivotal movement of said elevating means is transmitted to said second pivot means to pivot said drill guide carriage to a position parallel to the ground.

6. In a mine drilling machine, a drill steel guide as set forth in claim I which includes, said pair of drill guide members including a first lever arm and a second lever arm respectively, said first and second lever arms each including said guide portion at one end portion and means for pivotally connecting said lever arms to said drill guide carriage at the opposite end portion, a link member connecting said first lever arm to said second lever arm, said actuator means being supported by said drill guide carriage and connected to said first lever arm, and said actuator means being operable to pivot said first lever arm and thereby pivot said second lever arm through said link member to move said guide portions into and out of the closed drill guide position surrounding the drill steel.

7. In a mine drilling machine, a drill steel guide as set forth in claim 6 in which actuator means includes, a piston cylinder assembly having a cylinder portion pivotally connected to said drill guide carriage and an extensible piston rod pivotally connected to said first lever arm, said piston cylinder assembly being operable to extend said piston rod to pivotally move said first and second lever arms toward each other to move said guide portions into abutting relation to form a bore through which the drill steel passes when said first and second lever arms are in the closed drill guide position, and said piston cylinder assembly being operable to retract said piston rod to pivotally move said first and second lever arms away from each other to move said guide members out of abutting relation to the open position.

8. In a mine drilling machine, a drill steel guide as set forth in claim 1 which includes, roof support means pivotally supported on said front end portion of said drill guide boom assembly for engaging the mine roof to support the mine roof above said drill guide carriage.

9. In a mine drilling machine, a drill steel guide as set forth in claim 8 in which said roof support means includes, a frame member positioned above and in surrounding relation with said drill guide carriage, means for pivotally connecting said frame member to said front end portion of said drill guide boom assembly, and said frame member having an upper horizontal surface arranged to abut the mine roof when said drill guide boom assembly raises said drill guide carriage to an uppermost position adjacent the mine roof.

* * * * *